US008882516B2

(12) United States Patent
Tai et al.

(10) Patent No.: US 8,882,516 B2
(45) Date of Patent: Nov. 11, 2014

(54) ELECTRICAL CONNECTOR WITH RELIABLE SIGNAL TRANSMISSION

(71) Applicant: Alltop Electronics (Suzhou) Ltd., Taicang (CN)

(72) Inventors: Hung-Chi Tai, Jhonghe (TW); Yi-Chang Chen, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 120 days.

(21) Appl. No.: 13/626,410

(22) Filed: Sep. 25, 2012

(65) Prior Publication Data

US 2014/0011405 A1 Jan. 9, 2014

(30) Foreign Application Priority Data

Jul. 9, 2012 (CN) ..... 2012 1 0235400

(51) Int. Cl.
*H01R 12/00* (2006.01)

(52) U.S. Cl.
USPC ..... 439/79

(58) Field of Classification Search
USPC ..... 439/79, 108, 660
See application file for complete search history.

(56) References Cited

U.S. PATENT DOCUMENTS

| | | | | |
|---|---|---|---|---|
| 5,439,385 | A * | 8/1995 | Sakai et al. | 439/79 |
| 6,672,884 | B1 * | 1/2004 | Lim et al. | 439/79 |
| 6,758,685 | B1 * | 7/2004 | Huang et al. | 439/79 |
| 7,674,118 | B2 * | 3/2010 | He | 439/108 |
| 8,062,046 | B2 * | 11/2011 | Daily et al. | 439/290 |
| 8,376,783 | B2 * | 2/2013 | Kondo et al. | 439/660 |

* cited by examiner

*Primary Examiner* — Xuong Chung Trans
(74) *Attorney, Agent, or Firm* — Sughrue Mion, PLLC

(57) ABSTRACT

An electrical connector includes an insulative housing and at least one differential pair received in the insulative housing. The differential pair includes a first contact and a second contact. The first contact has a first signal transmission length and a first signal transmission path, and the second contact has a second signal transmission length and a second signal transmission path. The first signal transmission length of the first contact is equal to the second signal transmission length of the second contact, and the first signal transmission path of the first contact is different from the second signal transmission path of the second contact.

11 Claims, 7 Drawing Sheets

ELECTRICAL CONNECTOR WITH RELIABLE SIGNAL TRANSMISSION

BACKGROUND OF THE INVENTION

1. Field of the Invention

The present invention relates to an electrical connector, more particularly to an electrical connector with reliable signal transmission.

2. Description of Related Art

For high-frequency signal transmission, conventional connectors usually have a lower reliability on the signal transmission. A major reason resulting in the aforementioned disadvantages may be the different transmission lengths of the signal transmitting paths. Therefore, signals may travel in different transmitting speeds to arrive their destination in different time, where this may result an inaccurate output data. Thus, along with the wide use of high-frequency signal communication, it gradually becomes a critical issue to improve the reliability of signal transmission.

Hence, it is necessary to improve conventional electrical connectors to address the problems mentioned above.

BRIEF SUMMARY OF THE INVENTION

Accordingly, an object of the present invention is to provide an electrical connector with improved quality of high frequency signal transmission.

In order to achieve the above-mentioned object, an electrical connector comprises an insulative housing and at least one differential pair received in the insulative housing. The differential pair comprises a first contact and a second contact. The first contact has a first signal transmission length and a first signal transmission path, and the second contact has a second signal transmission length and a second signal transmission path. The first signal transmission length of the first contact is equal to the second signal transmission length of the second contact, and the first signal transmission path of the first contact is different from the second signal transmission path of the second contact.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
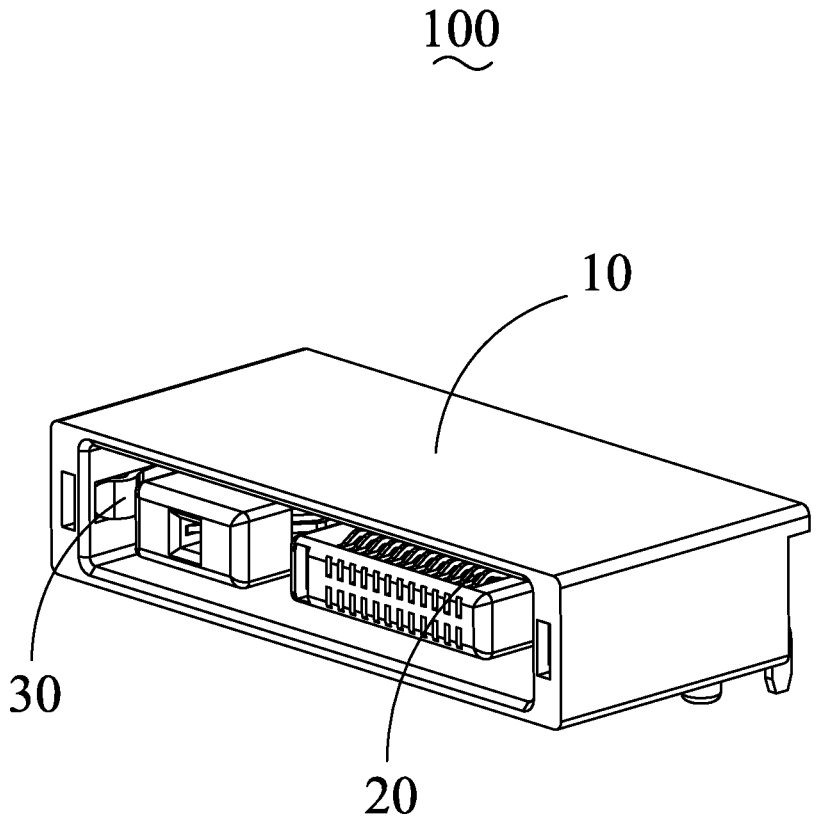
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
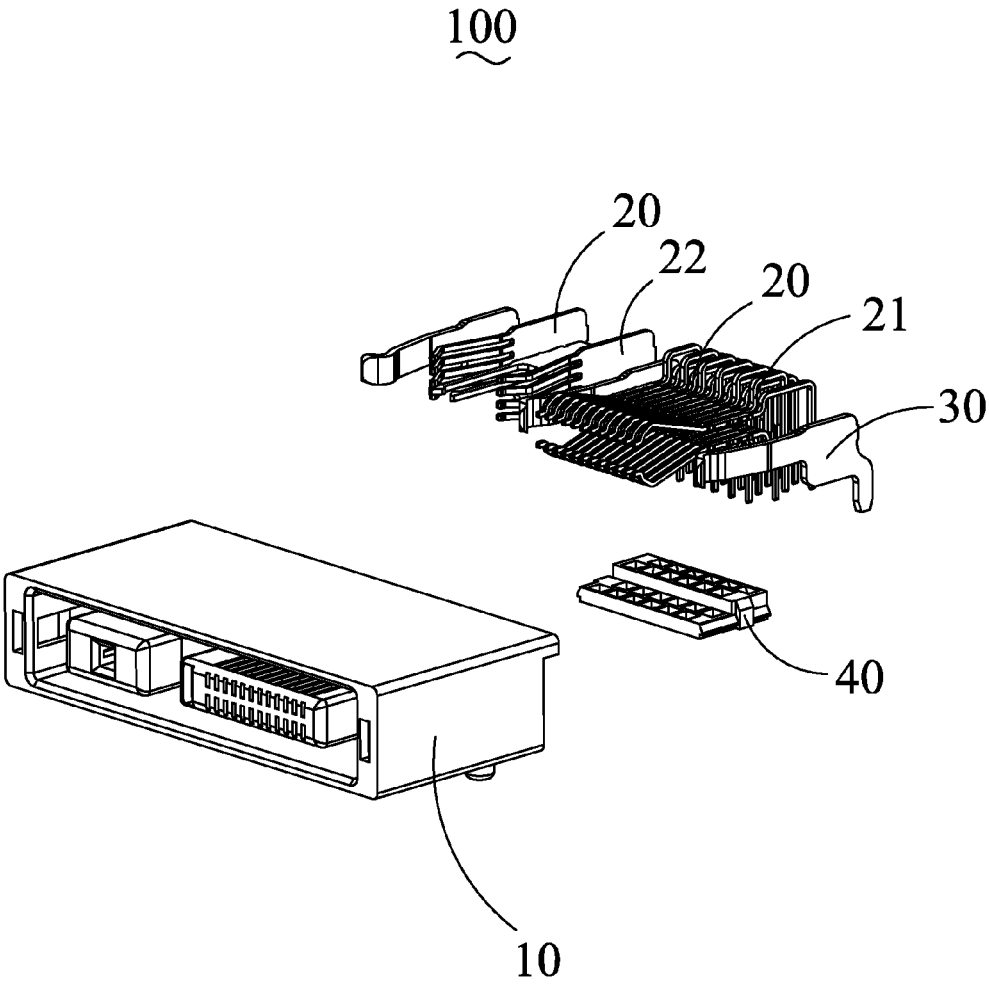
FIG. 2 is an exploded, perspective view of the electrical connector in accordance with the present invention.
Figure 3:
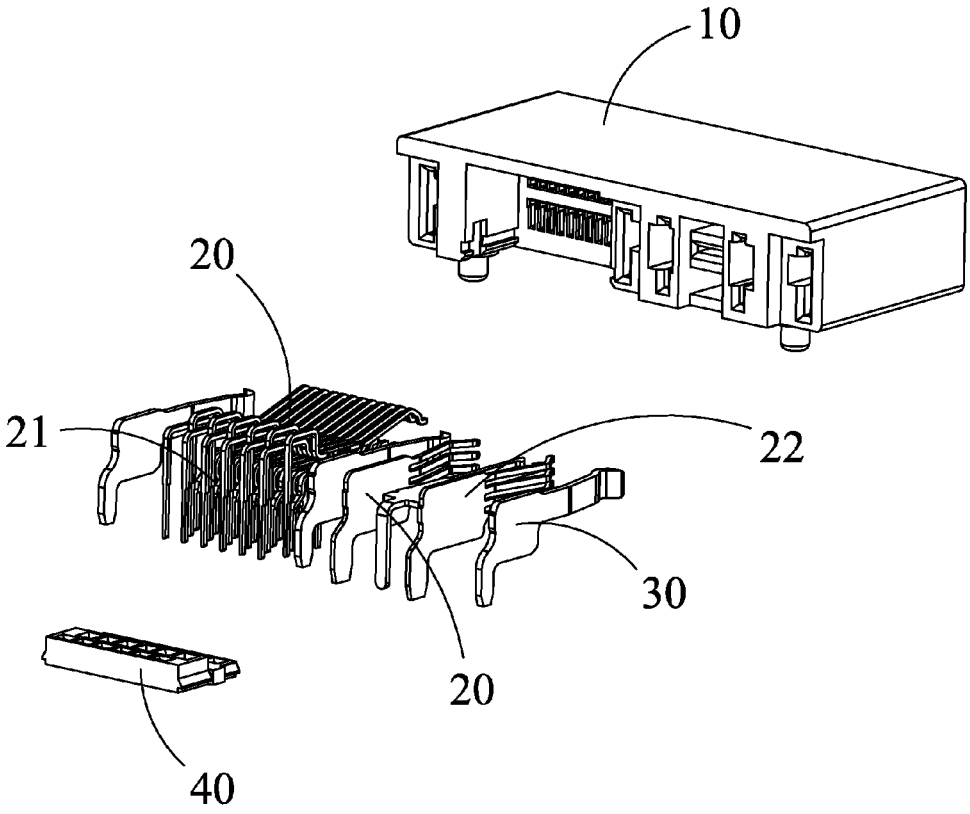
FIG. 3 is a view similar to FIG. 2, but viewed from a different aspect.

Please refer to FIGS. 1-3, an electrical connector 100 in accordance with the present invention comprises an insulative housing 10, a plurality of conductive contacts 20 accommodated in the insulative housing 10, a plurality of latching components 30 received in the insulative housing 10, and a fixing seat 40 for fixing the conductive contacts 20. The conductive contacts 20 comprise a plurality of signal contacts 21 and a plurality of power contacts 22. In the preferred embodiment of the present invention, the signal contacts 21 are differential pairs.

Figure 4:
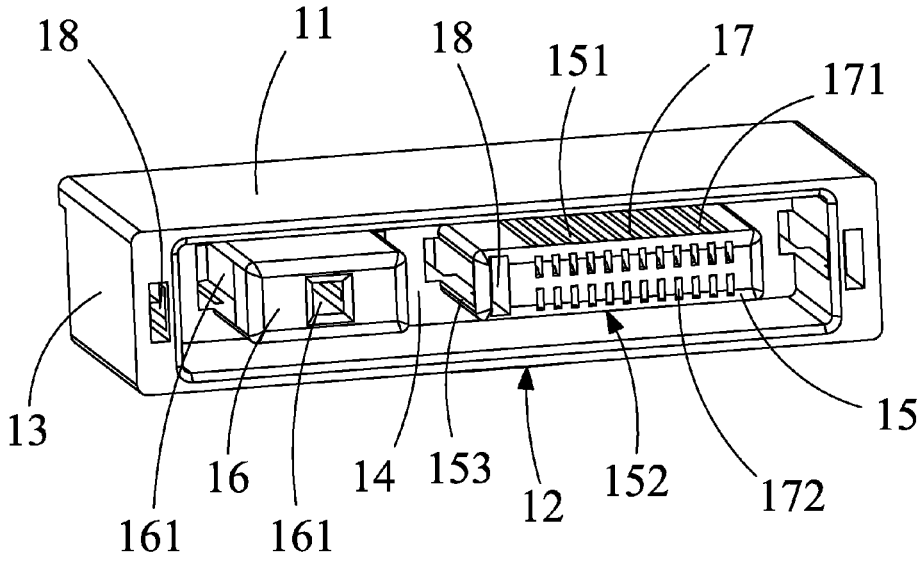
FIG. 4 is a perspective view of an insulative housing of the electrical connector.
Figure 5:
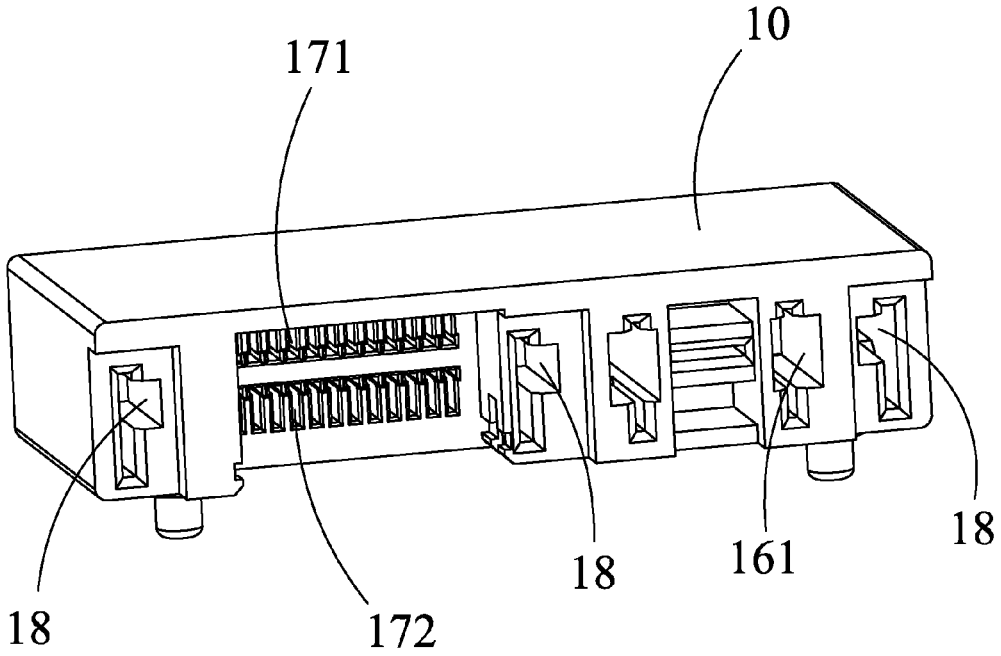
FIG. 5 is a view similar to FIG. 4, but from a different view.

Please refer to FIG. 4 in conjunction with FIG. 5, the insulative housing 10 comprises an upper wall 11, a lower wall 12 opposite to the upper wall 11, and a pair of lateral walls 13 connecting the upper wall 11 and the lower wall 12. A receiving space 14 is circumscribed by the upper wall 11, the lower wall 12 and the lateral walls 13 to receive a complementary connector (not shown). The insulative housing 10 also forms a first mating portion 15 to accommodate the signal contacts 21 and a second mating portion 16 to accommodate the power contacts 22. The first mating portion 15 and the second mating portion 16 are separated from each other and both extend into the receiving space 14.

The first mating portion 15 comprises an upper surface 151, a lower surface 152 opposite to the upper surface 151, and a pair of lateral surfaces 153 connecting the upper surface 151 and the lower surface 152. The first mating portion 15 defines a plurality of signal contact receiving slots 17 for receiving the signal contacts 21, and a through recess 18 for receiving the latching component 30. The signal contact receiving slots 17 comprise a plurality of first signal receiving slots 171 and a plurality of second signal receiving slots 172 respectively recessed downward and upwardly from the upper surface 151 and the lower surface 152 of the first mating portion 15 and exposed to the outside. The through recess 18 penetrates through the insulative housing 10 and communicates with the receiving space 14.

The second mating portion 16 defines three power contact receiving slots 161 communicating with the receiving space 14 to receive the power contacts 22. Two power contact receiving slots 161 are defined at opposite lateral sides of the second mating portion 16, and the other power contact receiving slot 161 is defined in the middle of the second mating portion 16. Each lateral wall 13 defines a through recess 18 penetrating through the insulative housing 10 and communicating with the receiving space 14 to receive the latching component 30.

Figure 6:
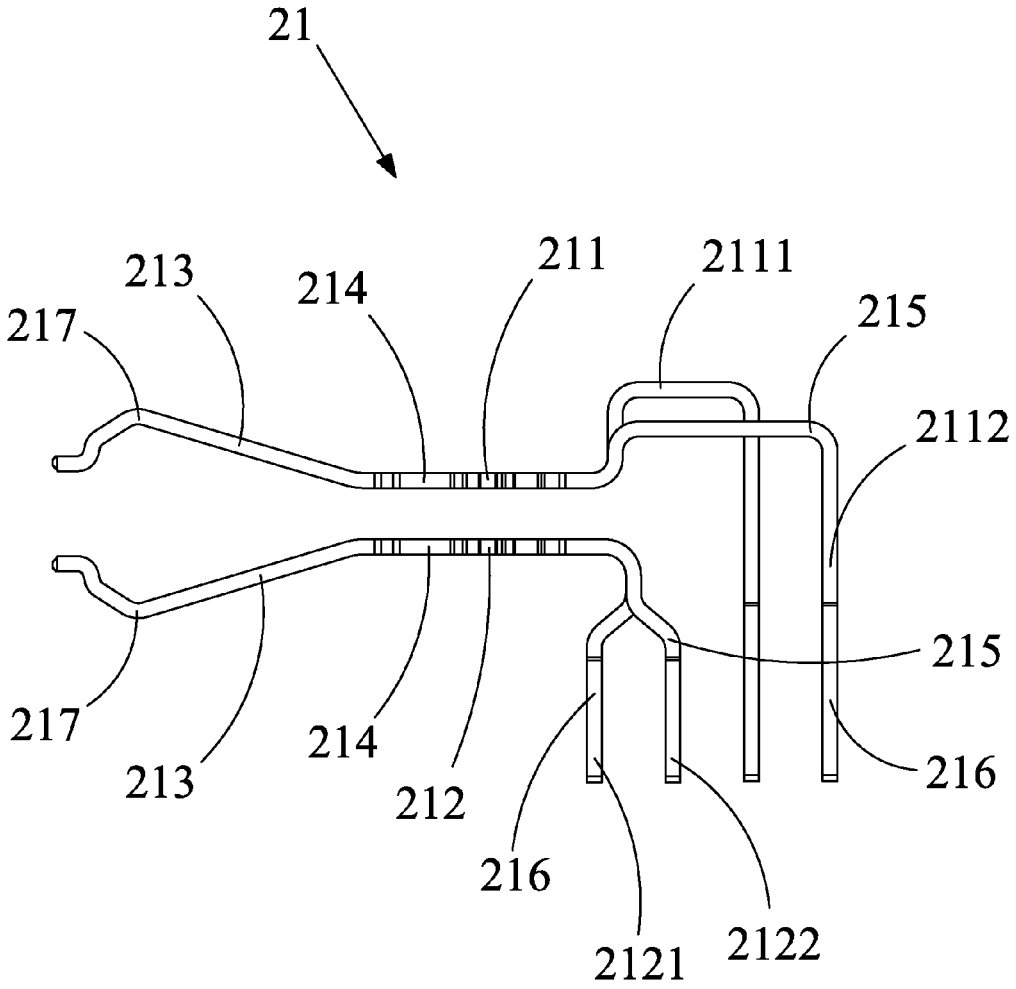
FIG. 6 is a perspective view of conductive contacts of the electrical connector in accordance with the present invention.

Please refer to FIGS. 2-3 in conjunction with FIG. 6, the conductive contacts 20 comprise the signal contacts 21 received in the signal contact receiving slots 17 and the power contacts 22 received in the power contact receiving slots 161. The signal contacts 21 comprise a plurality of first signal contacts 211 received in the first signal contact receiving slots 171 and a plurality of second signal contacts 212 received in the second signal contact receiving slots 172. Please refer to FIG. 6, each of the first and second signal contacts 211, 212 comprises an elastic contacting portion 213 exposed to the outside, a retaining portion 214 extending rearward from the contacting portion 213, a termination portion 216 extending beyond the insulative housing 10 and an intermediate portion 215 connecting the retaining portion 214 and the termination portion 216. The contacting portion 213 forms a curved protrusion 217 for electrically connecting with the complementary connector (not shown).

The first signal contacts 211 comprise a plurality of first contacts 2111 and a plurality of second contacts 2112. Since the first signal contacts 211 are differential pairs, the first contacts 2111 and the second contacts 2112 are in pairs to form the differential pairs. Each pair of the first contact 2111 and the second contact 2112 has the same signal transmission length but different signal transmission paths. That means, the first contact 2111 has a first signal transmission length and a first signal transmission path, and the second contact 2112 has a second signal transmission length and a second signal transmission path. The first signal transmission length is equal to the second signal transmission length, while the first signal transmission path and the second signal transmission path are different from each other. The intermediate portion 215 of the first contact 2111 is higher and shorter than the intermediate portion 215 of the second contact 2112, while the termination portion 216 of the first contact 2111 is longer than the termination portion 216 of the second contact 2112. The contacting portion 213 and the retaining portion 214 of the first and second contacts 2111, 2112 are the same. So, the total first signal transmission length of the first contact 2111 is equal to the second signal transmission length of the second contact 2112, although the first and second signal transmission paths are different because of the different configurations of the intermediate portions 215 and the termination portions 216. The retaining portions 214 of the first and second contacts 2111, 2112 are located in the same horizontal plane, that means, coplanar with each other. The termination portions 216 of the first contacts 2111 are located in the same first vertical plane perpendicular to the horizontal plane, or coplanar with each other. The termination portions 216 of the second contacts 2112 are located in the same second vertical plane behind the first vertical plane. As can be easily seen from FIGS. 3 and 6, the intermediate portions 215 of the first contacts 2111 extend along a horizontal plane or a first plane and the intermediate portions 215 of the second contacts 2112 extend along the other horizontal plane or a second plane. It should be emphasized that the first plane and the second plane are parallel with each other. In the preferred embodiment, the retaining portions 214 of the first contacts 2111 and the second contacts 2112 extend parallelly to the first and the second planes.

The second signal contacts 212 comprise a plurality of first contacts 2121 and a plurality of second contacts 2122. Since the second signal contacts 212 are differential pairs, the first contacts 2121 and the second contacts 2122 are in pairs to form the differential pairs. Each pair of the first contact 2121 and the second contact 2122 has the same signal transmission length but different signal transmission paths. That means, the first contact 2121 has a first signal transmission length and a first signal transmission path, and the second contact 2122 has a second signal transmission length and a second signal transmission path. The first signal transmission length of the first contact 2121 is equal to the second signal transmission length of the second contact 2122, while the first signal transmission path of the first contact 2121 and the second signal transmission path of the second contact 2122 are different from each other. The intermediate portion 215 of the first contact 2121 bends downward from the retaining portion 214 then obliquely and forwardly, while the intermediate portion 215 of the second contact 2122 bends downward from the retaining portion 214 then obliquely and reardward, however, the intermediate portions 215 of the first and second contacts 2121, 2122 have the same length. The angles formed by the intermediate portion 215 and the termination portion 216 of the first and second contacts 2121, 2122 are supplementary angles, and equal to each other. The contacting portions 213, the retaining portions 214 and the termination portions 216 of the first and second contacts 2121, 2122 are the same. So, the total first signal transmission length of the first contact 2121 is equal to the second signal transmission length of the second contact 2122, although the first and second signal transmission paths are different from each other because of the different configurations of the intermediate portions 215 of the first and second contacts 2121, 2122. The retaining portions 214 of the first and second contacts 2121, 2122 are located in the same horizontal plane, that means, coplanar with each other. The termination portions 216 of the first contacts 2121 are located in the same first vertical plane perpendicular to the horizontal plane, or coplanar with each other. The termination portions 216 of the second contacts 2122 are located in the same second vertical plane behind the first vertical plane. In summary, the signal contacts 21 of the electrical connector 100 in accordance with the present invention realize different signal transmission paths, but same signal transmission length via different bendings, thus assuring high quality high-frequency signal transmission.

Please refer to FIG. 3, the latching components 30 are elastic, and assembled in the through recesses 18 for latching with the complementary connector (not shown) received in the receiving space 14.

Figure 7:
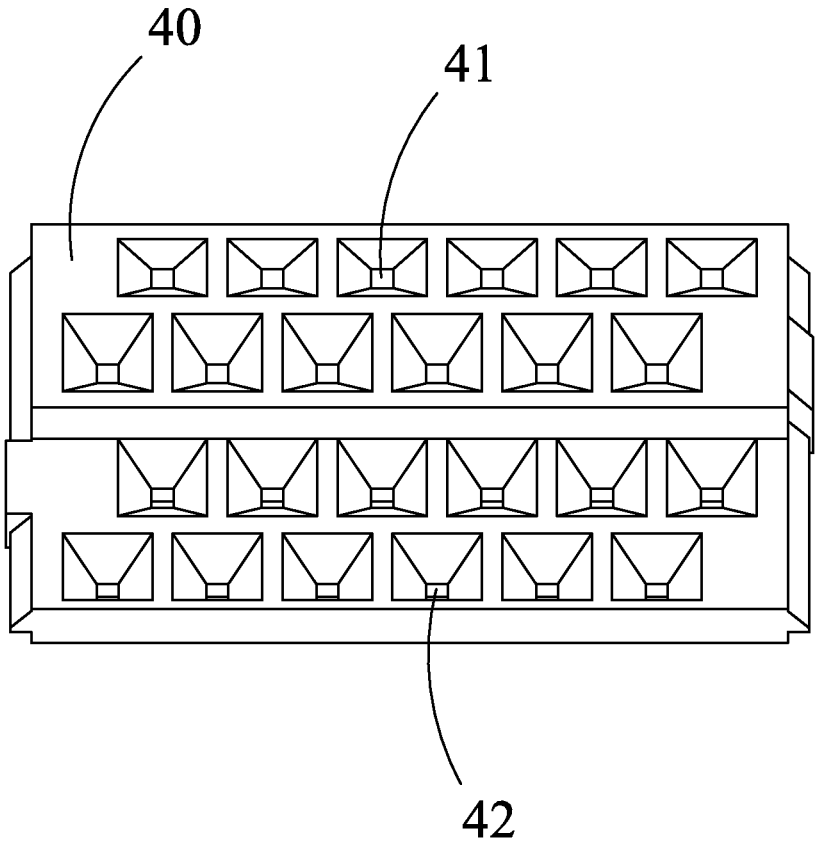
FIG. 7 is a perspective view of a fixing seat of the electrical connector in accordance with the present invention.

Please refer to FIG. 7 in conjunction with FIG. 7, the fixing seat 40 is for fixing the termination portions 216 of the signal contacts 21. The fixing seat 40 comprises a plurality of first fixing holes 41 to let the termination portions 216 of the first signal contacts 211 pass through, and a plurality of second fixing holes 42 to let the termination portions 216 of the second signal contacts 212 to pass through.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing;

at least one differential pair received in the insulative housing, the differential pair comprising a first contact and a second contact, the first contact having a first signal transmission length and a first signal transmission path, and the second contact having a second signal transmission length and a second signal transmission path, wherein the first signal transmission length of the first contact is equal to the second signal transmission length of the second contact, and the first signal transmission path of the first contact is different from the second signal transmission path of the second contact;

wherein each of the first contact and the second contact comprises a contacting portion, a retaining portion extending rearward from the contacting portion, a termination portion extending beyond the insulative housing, and an intermediate portion connecting the retaining portion and the termination portion;

wherein the intermediate portions of the first contacts extend along a first plane and the intermediate portions of the second contacts extend along a second plane, and wherein the first plane and the second plane are parallel with each other.

2. The electrical connector as claimed in claim 1, wherein at least one of the termination portions and the intermediate portions of the first and second contacts bend in different ways to form different first and second signal transmission paths.

3. The electrical connector as claimed in claim 1, wherein the intermediate portion and the termination portion of the first contact has different configurations from that of the second contact, and wherein the intermediate portion of the first contact is higher and shorter than the intermediate portion of the second contact, and the termination portion of the first contact is longer than the termination portion of the second contact, while the total length of the intermediate portion and the termination portion of the first contact is equal to that of the intermediate portion and the termination portion of the second contact.

4. The electrical connector as claimed in claim 1, wherein the termination portion of the first contact has a different configuration from that of the termination portion of the second contact, and wherein the total length of the termination portion of the first contact is equal to that of the termination portion of the second contact.

5. The electrical connector as claimed in claim 1, wherein the retaining portions of the first contacts and the retaining portions of the second contacts are located in a common horizontal plane.

6. The electrical connector as claimed in claim 5, wherein an angle formed by the intermediate portion and the termination portion of the first contact and that of the second contact are supplementary angles.

7. The electrical connector as claimed in claim 5, wherein the angle formed by the intermediate portion and the termination portion of the first contact and that of the second contact are equal to each other.

8. The electrical connector as claimed in claim 2, wherein the termination portions of the first contacts are located in a common first vertical plane, and wherein the termination portions of the second contacts are located in a common second vertical plane parallel to the first vertical plane.

9. The electrical connector as claimed in claim 2, further comprising a fixing seat to fix the termination portions of the first and second contacts.

10. The electrical connector as claimed in claim 9, wherein the fixing seat defines a plurality of fixing holes to let the termination portions of the first and second contacts to pass through.

11. The electrical connector as claimed in claim 1, further comprising at least one power contact received in the insulative housing, and wherein the insulative housing comprises a first mating portion and a second mating portion separated from the first mating portion and respectively accommodates the at least one differential pair and the at least one power contact.

* * * * *